US011896088B1

(12) United States Patent
Peng et al.

(10) Patent No.: US 11,896,088 B1
(45) Date of Patent: Feb. 13, 2024

(54) STRING TYING SYSTEM

(71) Applicant: Jiangxi Sichuangtong Intelligent Technology Co., Ltd., Yichun (CN)

(72) Inventors: Xiaomao Peng, Yichun (CN); Waixiu Kuang, Yichun (CN)

(73) Assignee: Jiangxi Sichuangtong Intelligent Technology Co., Ltd., Yichun (CN)

( * ) Notice: Subject to any disclaimer, the term of this patent is extended or adjusted under 35 U.S.C. 154(b) by 0 days.

(21) Appl. No.: 18/449,149

(22) Filed: Aug. 14, 2023

(30) Foreign Application Priority Data

Aug. 1, 2023 (CN) ..... 202322038618.4

(51) Int. Cl.
*A43C 11/16* (2006.01)
*A43C 7/04* (2006.01)

(52) U.S. Cl.
CPC ..... *A43C 7/04* (2013.01); *A43C 11/165* (2013.01)

(58) Field of Classification Search
CPC ..... A43C 11/165; A43C 11/16; A43C 7/04
See application file for complete search history.

(56) References Cited

U.S. PATENT DOCUMENTS

2018/0160775 A1* 6/2018 Pollack ..... A43C 7/00
2022/0119220 A1* 4/2022 Li ..... B65H 75/406
2023/0172317 A1* 6/2023 Pollack ..... A43C 11/20 24/68 B
2023/0248116 A1* 8/2023 Duller ..... A43C 11/165 24/68 SK

FOREIGN PATENT DOCUMENTS

CN 102014682 A 4/2011
CN 110785098 A 2/2020
CN 210539233 U 5/2020

* cited by examiner

*Primary Examiner* — Jack W Lavinder
(74) *Attorney, Agent, or Firm* — Nitin Kaushik

(57) ABSTRACT

The present application relates to the field of string tying buckles, in particular to a novel string tying system. A rotating cover and a rotating clamping member provided with a buckling portion and first clamping teeth are arranged in a split manner, so that the demolding difficulty is low, and the system is convenient to produce and assemble.

10 Claims, 9 Drawing Sheets

STRING TYING SYSTEM

CROSS-REFERENCE TO RELATED APPLICATIONS

The application claims priority to Chinese patent application No. 2023220386184, filed on Aug. 1, 2023, the entire contents of which are incorporated herein by reference.

TECHNICAL FIELD

The present application relates to the field of string tying buckles, in particular to a novel string tying system.

BACKGROUND

At present, with the development of technology, people's quality of life is gradually improved. Shoelaces of shoes, trouser straps of casual pants, ropes of lanyard bags, belts of medical appliances, ropes of clothes and caps, etc. are common applications of strings in daily life. During usage, people often fix the tightness of the strings through knotting. However, knots of the strings are often loosened due to vibration or other external force factors, which brings inconvenience to people.

Currently, the tightness of the strings is controlled by designing rotating string tying buckles. Each existing rotating string tying buckle generally includes a middle frame, a string wheel, a rotating cover, a clutch rotating disc and a base, and the rotating cover is provided, in an integrally molded manner, with a buckling portion connected to the clutch rotating disc and clamping teeth clamped with the string wheel. The rotating string tying buckles are generally small, internal parts are relatively precise, and the rotating covers of the existing rotating string tying buckles are connected to the buckling portions and the clamping teeth in an integrally molded manner, so that the demolding difficulty is high.

SUMMARY

The present application aims to provide a novel string tying system, and a rotating cover thereof and a rotating clamping member provided with a buckling portion and clamping teeth are arranged in a split manner, so that the demolding difficulty is low, and the system is convenient to assemble.

In order to achieve the above-mentioned purpose, the following technical solution is adopted for the present application:

the novel string tying system comprises a middle frame, a string wheel, the rotating cover, the rotating clamping member, a clutch rotating disc and a base, wherein the middle frame is buckled with the base; the string wheel and the clutch rotating disc are arranged between the middle frame and the base; the rotating cover covers the middle frame; the string wheel is connected to the base by means of the clutch rotating disc; the rotating cover is provided with a first accommodating groove downwards; the first accommodating groove is internally provided with first buckles; the rotating clamping member is provided with clamping blocks corresponding to the first buckles; an upper end of the middle frame is provided with a first avoiding hole in communication with the interior of the middle frame; an outer side of the rotating clamping member is provided, in a radially outward protruding manner, with a first flange for buckling an edge of the first avoiding hole; the rotating clamping member is provided with the buckling portion and a plurality of first clamping teeth arranged in an annularly arrayed manner; the clutch rotating disc is provided upwards with a sliding buckle corresponding to the buckling portion; the string wheel is provided with a second avoiding hole; the sliding buckle penetrates through the second avoiding hole to be clamped with the buckling portion of the rotating clamping member; the string wheel is provided upwards with first clamping grooves corresponding to the plurality of first clamping teeth; during assembly, the clutch rotating disc is connected to the rotating clamping member through cooperation of the sliding buckle with the buckling portion; and during usage, the rotating cover is rotated downwards, and the rotating clamping member is clamped with the string wheel through cooperation of the first clamping teeth and the first clamping grooves.

As a preferred solution, the first clamping teeth are oblique teeth, and the first clamping grooves are oblique grooves, so that the first clamping teeth are more easily clamped with the first clamping grooves.

As a preferred solution, the clutch rotating disc is provided downwards with a plurality of second clamping teeth arranged in an annularly arrayed manner, the base is provided with second clamping grooves corresponding to the plurality of second clamping teeth, and during usage, the clutch rotating disc is clamped with the second clamping grooves by means of the second clamping teeth.

As a preferred solution, a lower end of the clutch rotating disc is provided with a second accommodating groove, the second accommodating groove is internally provided with the plurality of second clamping teeth, the base is provided with a third accommodating groove, a lower end of the middle frame is mounted in the third accommodating groove, and the third accommodating groove is internally provided with the plurality of second clamping grooves.

As a preferred solution, an axis of the rotating clamping member is provided with a third avoiding hole, an inner wall of the third avoiding hole is provided with the buckling portion, the sliding buckle comprises a rotating shaft, one end of the rotating shaft is connected to the clutch rotating disc, and the other end of the rotating shaft is provided with an elastic buckling body corresponding to the buckling portion.

As a preferred solution, an edge of the upper end of the middle frame is provided with a second flange in a radially outward protruding manner, a side wall of the first accommodating groove is provided with a plurality of second buckles for buckling the second flange, and the plurality of second buckles are distributed in an annularly arrayed manner with an axis of the rotating cover serving as a circle center.

As a preferred solution, an outer side of the clutch rotating disc is provided with a plurality of elastic rotating arms, the elastic rotating arms are provided with elastic teeth, the string wheel extends downwards and integrally to form a first surrounding edge, an inner side wall of the first surrounding edge is provided, in an annularly arrayed manner, with a plurality of inner teeth for preventing the elastic teeth from rotating, the elastic teeth are connected to the inner teeth in an engaged manner such that the clutch rotating disc can only rotate in a single direction, the height of the inner teeth is equal to the sum of the depth of the second clamping grooves and the tooth width of the second clamping teeth, a tooth width direction of the elastic teeth and the inner teeth is parallel with an axis of the string wheel, and the elastic teeth can move up and down along tooth grooves between the inner teeth.

As a preferred solution, the string wheel is provided with a string penetrating hole for tying a string and a string receiving groove for receiving the string, an outer side wall of the middle frame is provided with a string penetrating groove in communication with the string receiving groove in the middle frame, and the base is provided with a string penetrating port adapted to the string penetrating groove.

As a preferred solution, a protective sleeve is sleeved on the rotating cover, and damage caused by bumps to the rotating cover is avoided by means of the protective sleeve.

As a preferred solution, axes of the middle frame, the string wheel, the rotating cover, the rotating clamping member and the clutch rotating disc are located on the same straight line.

The present application has the following beneficial effects:

with regard to the present application, the rotating cover and the rotating clamping member provided with the buckling portion and the first clamping teeth are arranged in the split manner, so that the demolding difficulty is low, and the system is convenient to produce and assemble; the first clamping teeth are the oblique teeth, and the first clamping grooves are the oblique grooves, so that the jamming feeling when a rotating string tying buckle is rotated during usage can be reduced; and the protective sleeve is sleeved on the rotating cover, thereby avoiding the damage caused by the bumps to the rotating cover.

In order to illustrate the structural features, the technical means and the specific purposes and functions of the present application more clearly, the present application is further described in detail below in conjunction with the accompanying drawings and the particular embodiments.

DESCRIPTION OF REFERENCE NUMERALS

Figure 1:
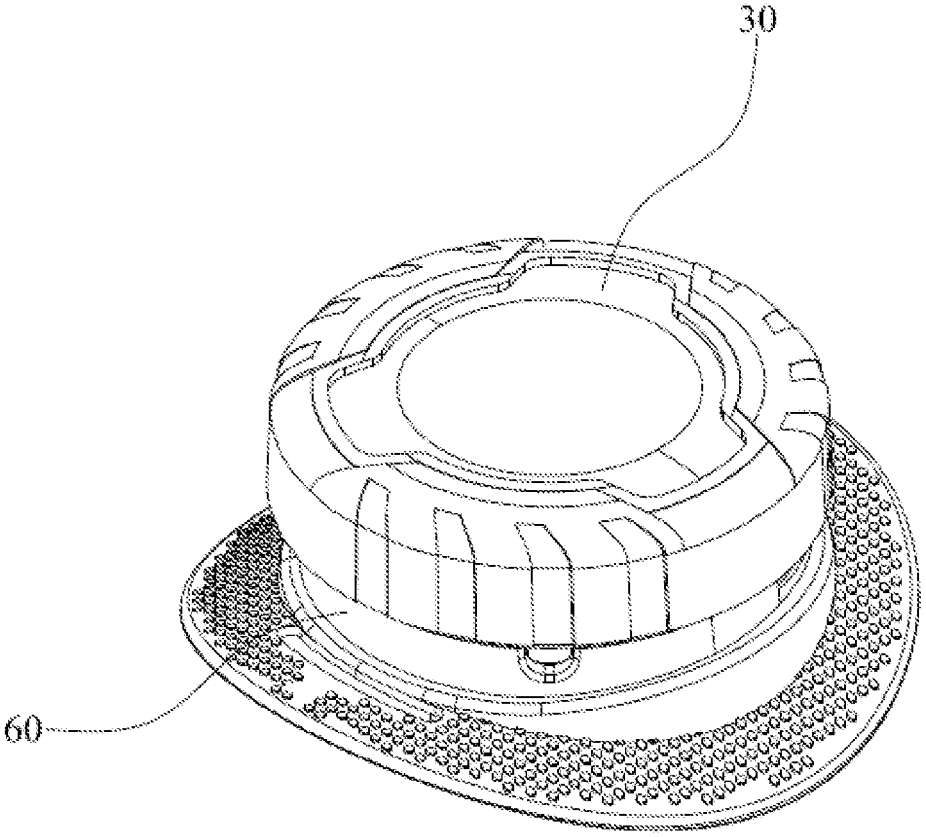
FIG. 1 is a stereogram of the present application.
Figure 2:
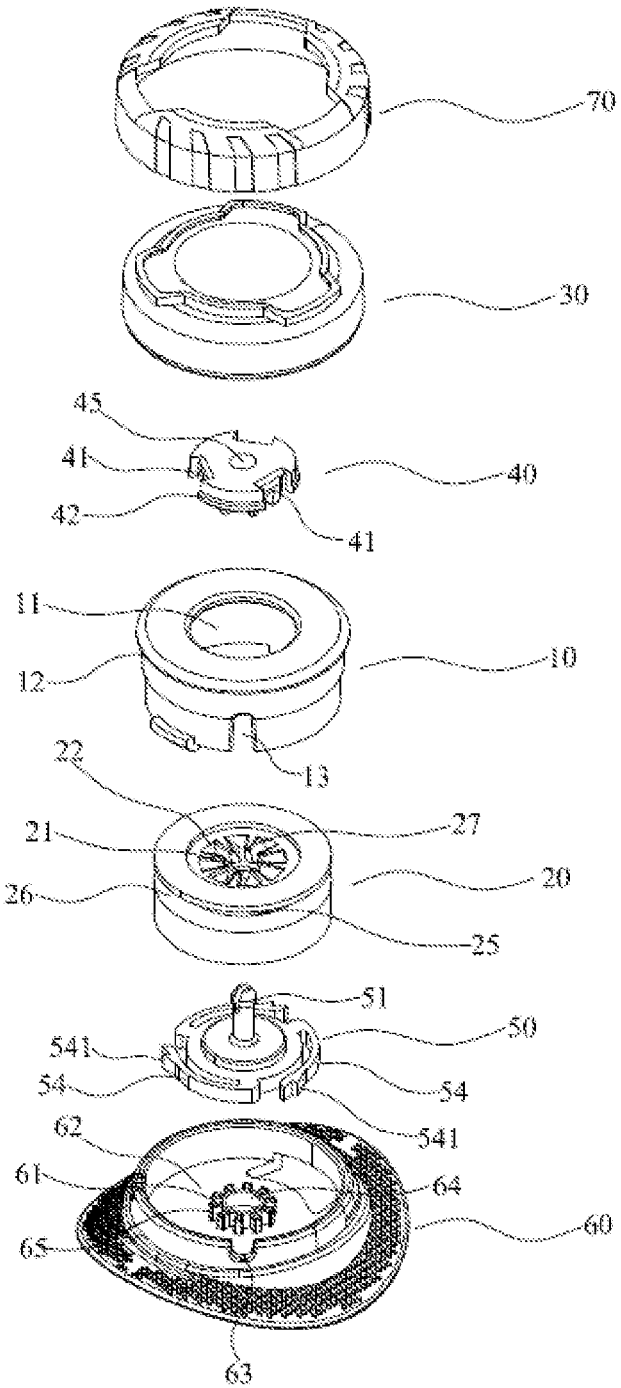
FIG. 2 is an exploded view of the present application.
Figure 3:
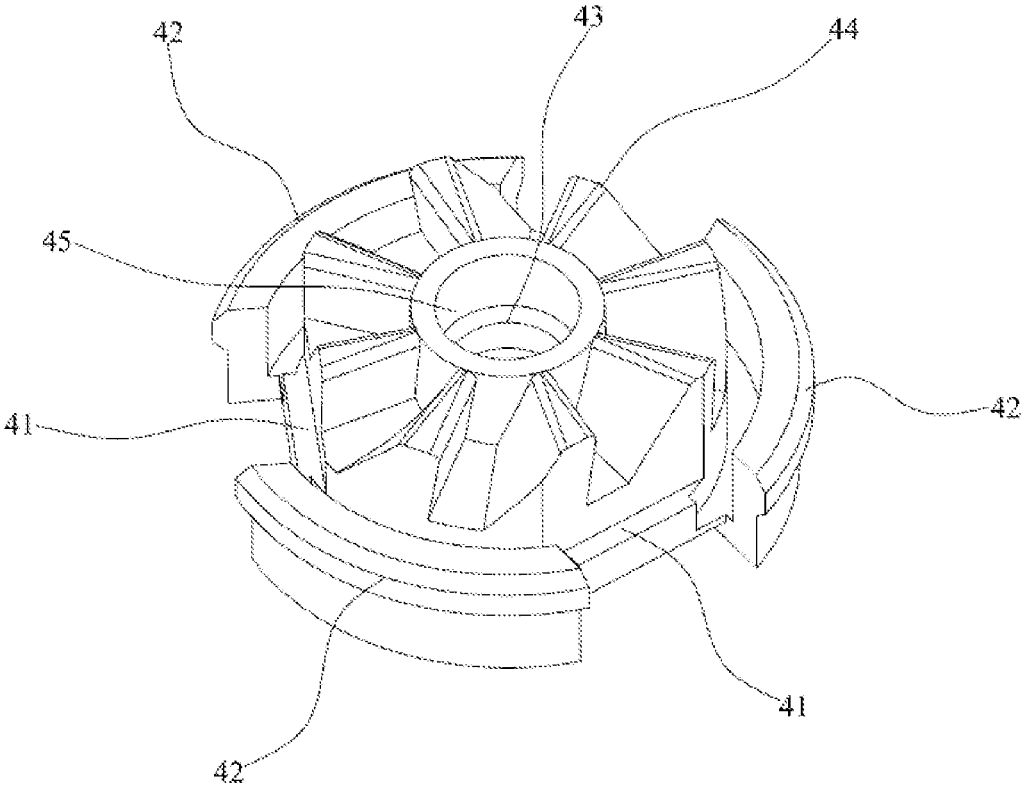
FIG. 3 is a structure diagram of a rotating clamping member in Embodiment 1.
Figure 4:
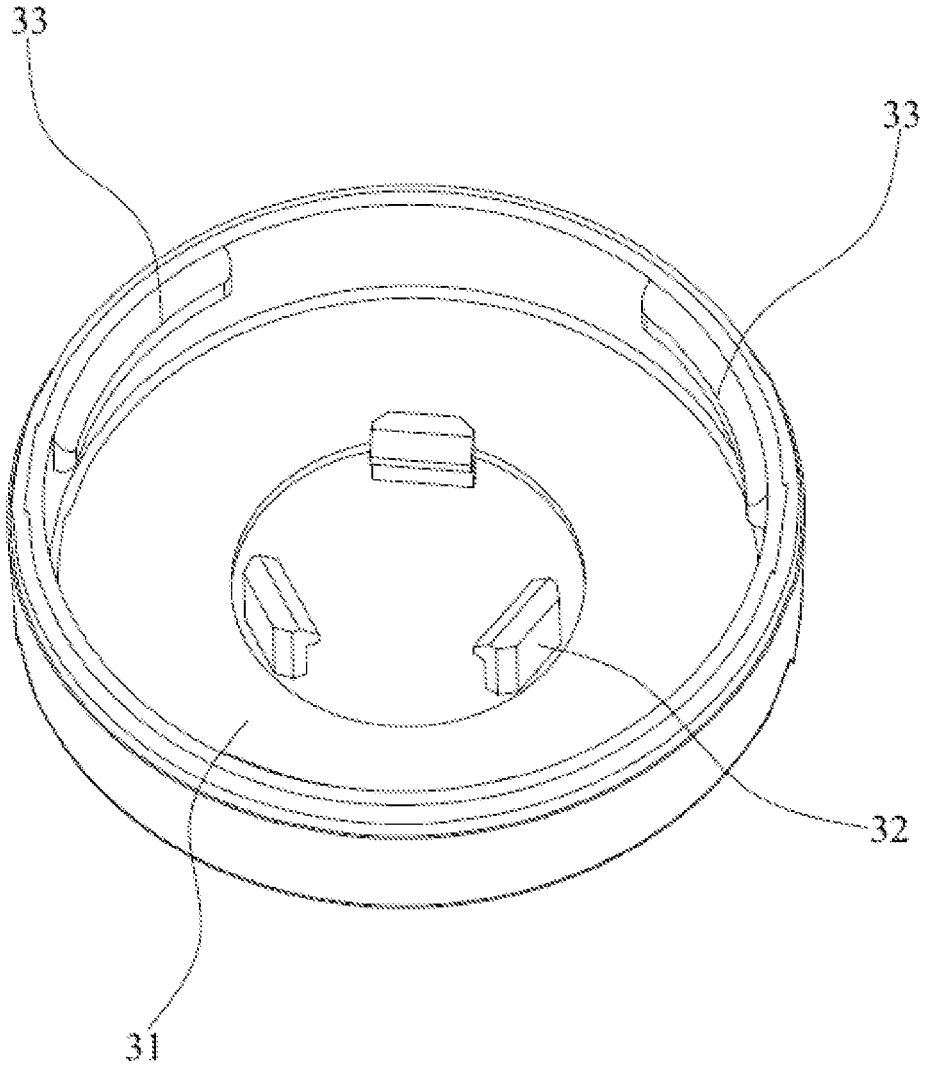
FIG. 4 is a structure diagram of a rotating cover of the present application.
Figure 5:
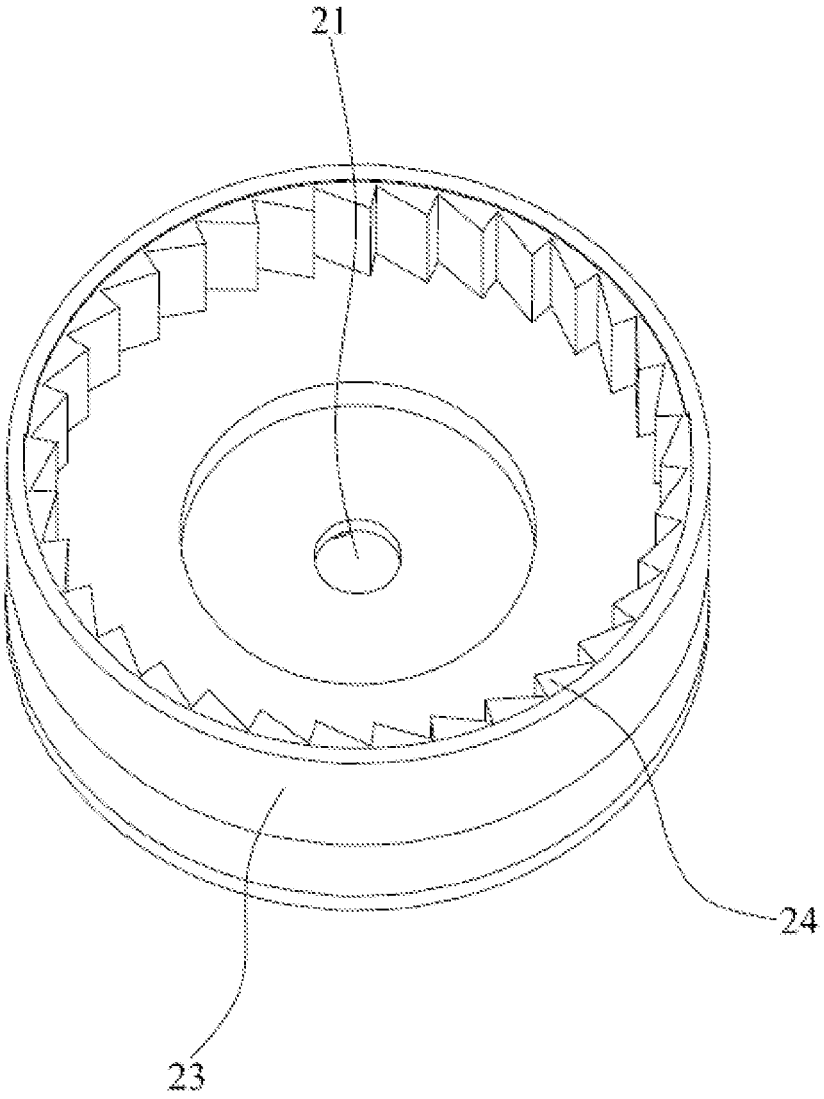
FIG. 5 is a structure diagram of a string wheel of the present application.
Figure 6:
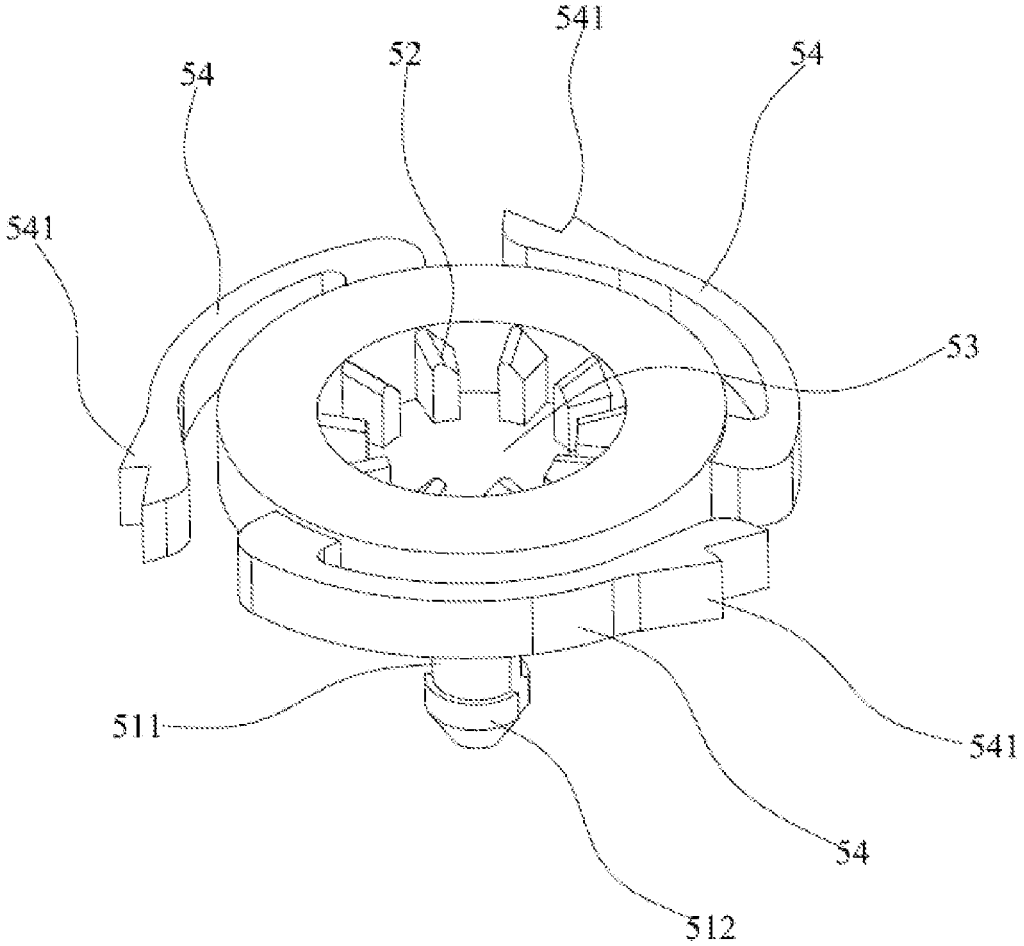
FIG. 6 is a structure diagram of a clutch rotating disc in Embodiment 1.

10—middle frame; 11—first avoiding hole; 12—second flange;

13—string penetrating groove; 20—string wheel; 21—second avoiding hole;

22—first clamping groove; 23—first surrounding edge; 24—inner tooth;

25—string penetrating hole; 26—string receiving groove; 27—first clamping block;

30—rotating cover; 31—first accommodating groove; 32—first buckle;

33—second buckle; 40—rotating clamping member; 41—clamping block;

42—first flange; 43—buckling portion; 44—first clamping tooth;

45—third avoiding hole; 50—clutch rotating disc; 51—sliding buckle;

511—rotating shaft; 512—elastic buckling body; 52—second clamping tooth;

53—second accommodating groove; 54—elastic rotating arm; 541—elastic tooth;

55—second reinforcing portion; 60—base; 61—second clamping groove;

62—third accommodating groove; 63—string penetrating port; 64—first reinforcing portion;

65—second clamping block; 66—second surrounding edge; and 70—protective sleeve.

DETAILED DESCRIPTION OF THE EMBODIMENTS

In the description of the present application, it should be noted that orientation or position relationships indicated by terms such as "central", "upper", "lower", "left", "right", "vertical", "horizontal", "inner", "outer" and the like are orientation or position relationships based on the accompanying drawings, are only for the purposes of facilitating the description of the present application and simplifying the description, and do not indicate or imply that a device or an element referred to must have the specific orientation or be constructed and operated in the specific orientation. Therefore, they cannot be understood as limitations on the present application.

In the description of the present application, it should also be noted that unless otherwise specified and limited, the terms "mounting", "connecting" and "connection" should be understood in a broad sense, for example, they may be fixed connection, and may also be detachable connection or integrated connection; they may be mechanical connection, and may also be electrical connection; and they may be direct connection, and may also be indirect connection by means of intermediate media or communication of the interiors of two elements. The specific meanings of the above terms in the present application may be understood by those of ordinary skill in the art depending on specific circumstances.

As shown in FIGS. 1-9, a novel string tying system includes a middle frame 10, a string wheel 20, a rotating cover 30, a rotating clamping member 40, a clutch rotating disc 50 and a base 60, wherein the middle frame 10 is buckled with the base 60; the string wheel 20 and the clutch rotating disc 50 are arranged between the middle frame 10 and the base 60; the rotating cover 30 covers the middle frame 10; the string wheel 20 is connected to the base 60 by means of the clutch rotating disc 50; the rotating cover 30 is provided with a first accommodating groove 31 downwards; the first accommodating groove 31 is internally provided with first buckles 32; the rotating clamping member 40 is provided with clamping blocks 41 corresponding to the first buckles 32; an upper end of the middle frame 10 is provided with a first avoiding hole 11 in communication with the interior of the middle frame 10; an outer side of the rotating clamping member 40 is provided, in a radially outward protruding manner, with a first flange 42 for buckling an edge of the first avoiding hole 11; the rotating clamping member 40 is provided with a buckling portion 43 and a plurality of first clamping teeth 44 arranged in an annularly arrayed manner; the clutch rotating disc 50 is provided upwards with a sliding buckle 51 corresponding to the buckling portion 43; the string wheel 20 is provided with a second avoiding hole 21; the sliding buckle 51 penetrates through the second avoiding hole 21 to be clamped with the buckling portion 43 of the rotating clamping member 40; the string wheel 20 is provided upwards with first clamping grooves 22 corresponding to the plurality of first clamping teeth 44; during assembly, the clutch rotating disc 50 is connected to the rotating clamping member 40 through cooperation of the sliding buckle 51 with the buckling portion 43; and during usage, the rotating cover 30 is rotated downwards, and the rotating clamping member 40 is clamped with the string wheel 20 through cooperation of the first clamping teeth 44 and the first clamping grooves 22.

The clutch rotating disc 50 is provided downwards with a plurality of second clamping teeth 52 arranged in an annularly arrayed manner, the base 60 is provided with second clamping grooves 61 corresponding to the plurality of second clamping teeth 52, and during usage, the clutch rotating disc 50 is clamped with the second clamping grooves 61 by means of the second clamping teeth 52.

A lower end of the clutch rotating disc 50 is provided with a second accommodating groove 53, the second accommodating groove 53 is internally provided with the plurality of second clamping teeth 52, the base 60 is provided with a third accommodating groove 62, a lower end of the middle frame 10 is mounted in the third accommodating groove 62, and the third accommodating groove 62 is internally provided with the plurality of second clamping grooves 61.

An axis of the rotating clamping member 40 is provided with a third avoiding hole 45, an inner wall of the third avoiding hole 45 is provided with the buckling portion 43, the sliding buckle 51 includes a rotating shaft 511, one end of the rotating shaft 511 is connected to the clutch rotating disc 50, and the other end of the rotating shaft 511 is provided with an elastic buckling body 512 corresponding to the buckling portion 43.

An edge of the upper end of the middle frame 10 is provided with a second flange 12 in a radially outward protruding manner, a side wall of the first accommodating groove 31 is provided with a plurality of second buckles 33 for buckling the second flange 12, and the plurality of second buckles 33 are distributed in an annularly arrayed manner with an axis of the rotating cover 30 serving as a circle center.

An outer side of the clutch rotating disc 50 is provided with a plurality of elastic rotating arms 54, the elastic rotating arms 54 are provided with elastic teeth 541, the string wheel 20 extends downwards and integrally to form a first surrounding edge 23, an inner side wall of the first surrounding edge 23 is provided, in an annularly arrayed manner, with a plurality of inner teeth 24 for preventing the elastic teeth 541 from rotating, the elastic teeth 541 are connected to the inner teeth 24 in an engaged manner such that the clutch rotating disc 50 can only rotate in a single direction, the height of the inner teeth 24 is equal to the sum of the depth of the second clamping grooves 61 and the tooth width of the second clamping teeth 52, a tooth width direction of the elastic teeth 541 and the inner teeth 24 is parallel with an axis of the string wheel 20, and the elastic teeth 541 can move up and down along tooth grooves between the inner teeth 24.

The string wheel 20 is provided with a string penetrating hole 25 for tying a string and a string receiving groove 26 for receiving the string, an outer side wall of the middle frame 10 is provided with a string penetrating groove 13 in communication with the string receiving groove 26 in the middle frame 10, and the base 60 is provided with a string penetrating port 63 adapted to the string penetrating groove.

A protective sleeve 70 is sleeved on the rotating cover 30, and damage caused by bumps to the rotating cover 30 is avoided by means of the protective sleeve 70.

Axes of the middle frame 10, the string wheel 20, the rotating cover 30, the rotating clamping member 40 and the clutch rotating disc 50 are located on the same straight line.

Embodiment 1

As shown in FIGS. 1-6, in this embodiment, in order to make the first clamping teeth 44 more easily clamped with the first clamping grooves 22, the first clamping teeth 44 are oblique teeth, and the first clamping grooves 22 are oblique grooves, an upper end of the rotating disc is provided with a plurality of first clamping blocks 27 arranged in an annularly arrayed manner, each first clamping groove 22 is formed between every two adjacent first clamping blocks 27, the ends of the plurality of first clamping blocks 27 facing the rotating clamping member 40 are tapered, and thus the first clamping teeth 44 are easily inserted into the first clamping grooves 22.

The bottom and an inner side wall of the second accommodating groove 53 integrally extend to form the second clamping teeth 52, the third accommodating groove 62 is internally provided with a first reinforcing portion 64, the first reinforcing portion 64 and the bottom of the third accommodating groove 62 integrally extend to form a plurality of second clamping blocks 65 arranged in an annularly arrayed manner, and each second clamping groove 61 is formed between every two adjacent clamping blocks.

Embodiment 2

Figure 7:
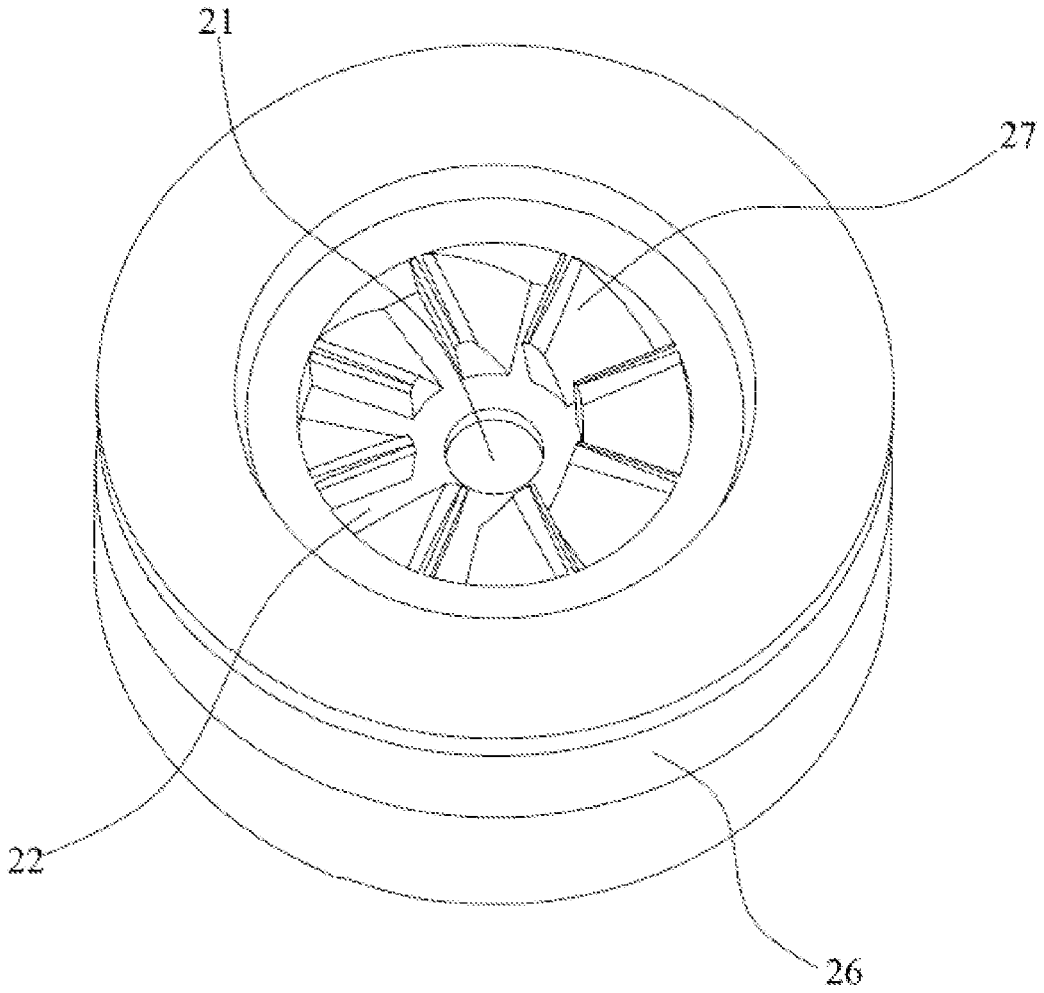
FIG. 7 is a structure diagram of a string wheel in Embodiment 2.
Figure 8:
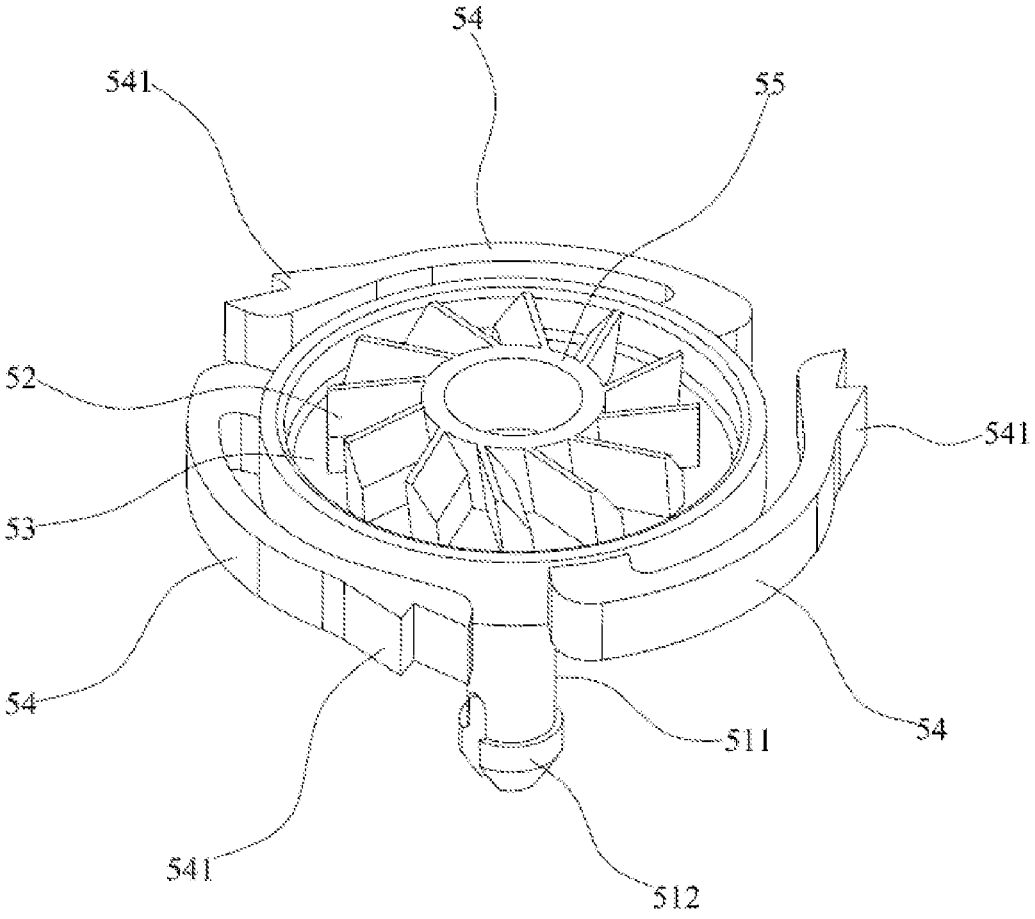
FIG. 8 is a structure diagram of a rotating clamping member in Embodiment 2.
Figure 9:
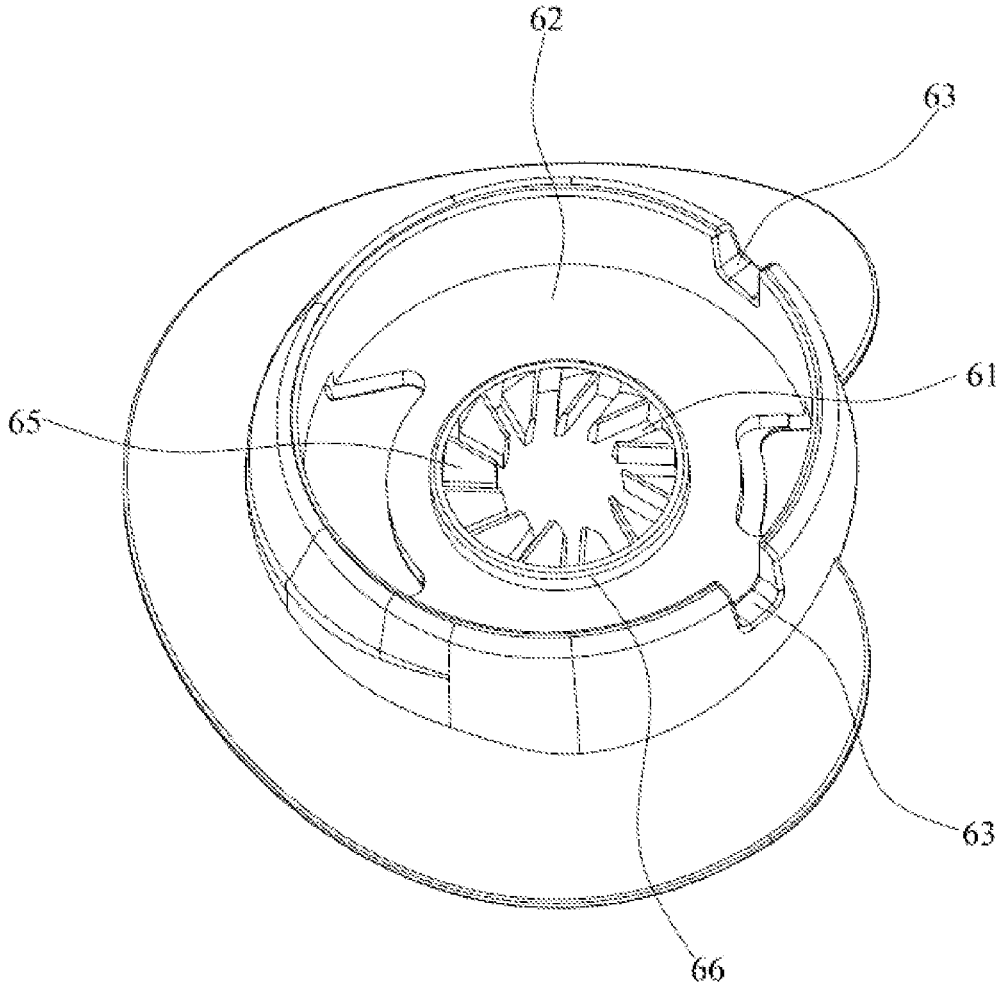
FIG. 9 is a structure diagram of a base in Embodiment 2.

As shown in FIGS. 7-9, the differences between this embodiment and the above-mentioned embodiment lie in that the thickness of the ends of the plurality of first clamping blocks 27 facing the rotating clamping member 40 is greater than that of the ends of the first clamping blocks 27 facing the rotating clamping member 40 in Embodiment 1, and the thickness of the ends of the first clamping blocks 27 facing the rotating clamping member 40 is increased to prevent the first clamping blocks 27 from being broken during the clamping process.

The second accommodating groove 53 is internally provided with a second reinforcing portion 55, the second clamping teeth 52 are integrally connected to the bottom of the second accommodating groove 53 and an outer side wall of the second reinforcing portion 55, the third accommodating groove 62 is internally provided with a second surrounding edge 66, an inner side wall of the second surrounding edge 66 and the bottom of the third accommodating groove 62 integrally extend to form a plurality of second clamping blocks 65 arranged in an annularly arrayed manner, and each second clamping groove 61 is formed between every two adjacent clamping blocks.

In conclusion, with regard to the present application, the rotating cover 30 and the rotating clamping member 40 provided with the buckling portion 43 and the first clamping teeth 44 are arranged in the split manner, so that the demolding difficulty is low, and the system is convenient to produce and assemble; the first clamping teeth 44 are the oblique teeth, and the first clamping grooves 22 are the oblique grooves, so that the jamming feeling when a shoelace rotating buckle is rotated during usage can be reduced; and the protective sleeve 70 is sleeved on the rotating cover 30, thereby avoiding the damage caused by the bumps to the rotating cover 30.

The above are only the preferred embodiments of the present application, and are not intended to limit the present application. Therefore, any amendment, equivalent substitution, or improvement made to the above embodiments in accordance with the technical practices of the present application still falls within the scope of the technical solutions of the present application.

What is claimed is:

1. A novel string tying system, comprising a middle frame, a string wheel, a rotating cover, a rotating clamping member, a clutch rotating disc and a base, wherein the middle frame is buckled with the base; the string wheel and the clutch rotating disc are arranged between the middle frame and the base; the rotating cover covers the middle frame; the string wheel is connected to the base by means of the clutch rotating disc; the rotating cover is provided with a first accommodating groove downwards; the first accommodating groove is internally provided with first buckles; the rotating clamping member is provided with clamping blocks corresponding to the first buckles; an upper end of the middle frame is provided with a first avoiding hole in communication with an interior of the middle frame; an outer side of the rotating clamping member is provided, in a radially outward protruding manner, with a first flange for buckling an edge of the first avoiding hole; the rotating clamping member is provided with a buckling portion and a plurality of first clamping teeth arranged in an annularly arrayed manner; the clutch rotating disc is provided upwards with a sliding buckle corresponding to the buckling portion; the string wheel is provided with a second avoiding hole; the sliding buckle penetrates through the second avoiding hole to be clamped with the buckling portion of the rotating clamping member; the string wheel is provided upwards with first clamping grooves corresponding to the plurality of first clamping teeth; the clutch rotating disc is connected to the rotating clamping member through cooperation of the sliding buckle with the buckling portion; and during usage, the rotating cover is rotated downwards, and the rotating clamping member is clamped with the string wheel through cooperation of the first clamping teeth and the first clamping grooves.

2. The novel string tying system according to claim 1, wherein the first clamping teeth are oblique teeth.

3. The novel string tying system according to claim 1, wherein the clutch rotating disc is provided downwards with a plurality of second clamping teeth arranged in an annularly arrayed manner, the base is provided with second clamping grooves corresponding to the plurality of second clamping teeth, and during usage, the clutch rotating disc is clamped with the second clamping grooves by means of the second clamping teeth.

4. The novel string tying system according to claim 3, wherein a lower end of the clutch rotating disc is provided with a second accommodating groove, the second accommodating groove is internally provided with the plurality of second clamping teeth, the base is provided with a third accommodating groove, a lower end of the middle frame is mounted in the third accommodating groove, and the third accommodating groove is internally provided with the plurality of second clamping grooves.

5. The novel string tying system according to claim 1, wherein an axis of the rotating clamping member is provided with a third avoiding hole, an inner wall of the third avoiding hole is provided with the buckling portion, the sliding buckle comprises a rotating shaft, one end of the rotating shaft is connected to the clutch rotating disc, and the other end of the rotating shaft is provided with an elastic buckling body corresponding to the buckling portion.

6. The novel string tying system according to claim 1, wherein an edge of the upper end of the middle frame is provided with a second flange in a radially outward protruding manner, a side wall of the first accommodating groove is provided with a plurality of second buckles for buckling the second flange, and the plurality of second buckles are distributed in an annularly arrayed manner with an axis of the rotating cover serving as a circle center.

7. The novel string tying system according to claim 1, wherein an outer side of the clutch rotating disc is provided with a plurality of elastic rotating arms, the elastic rotating arms are provided with elastic teeth, the string wheel extends downwards and integrally to form a first surrounding edge, an inner side wall of the first surrounding edge is provided, in an annularly arrayed manner, with a plurality of inner teeth for preventing the elastic teeth from rotating, the elastic teeth are connected to the inner teeth in an engaged manner, a height of the inner teeth is equal to the sum of a depth of the second clamping grooves and a tooth width of the second clamping teeth, a tooth width direction of the elastic teeth and the inner teeth is parallel with an axis of the string wheel, and the elastic teeth can move up and down along tooth grooves between the inner teeth.

8. The novel string tying system according to claim 1, wherein the string wheel is provided with a string penetrating hole for tying a string and a string receiving groove for receiving the string, an outer side wall of the middle frame is provided with a string penetrating groove in communication with the string receiving groove in the middle frame, and the base is provided with a string penetrating port adapted to the string penetrating groove.

9. The novel string tying system according to claim 1, wherein a protective sleeve is sleeved on the rotating cover.

10. The novel string tying system according to claim 1, wherein axes of the middle frame, the string wheel, the rotating cover, the rotating clamping member and the clutch rotating disc are located on the same straight line.

* * * * *